US005096199A

United States Patent [19]

Wyatt, Jr. et al.

[11] Patent Number: 5,096,199

[45] Date of Patent: Mar. 17, 1992

[54] GOLF SWING TRAINING DEVICE

[76] Inventors: Harry M. Wyatt, Jr., 922 Woodcrest Dr., Stillwater, Okla. 74074-1463; Frank Wyatt, No. 11 Oakhurst South, Glenwood Springs, Colo. 81601

[21] Appl. No.: 747,352

[22] Filed: Aug. 20, 1991

[51] Int. Cl.[5] ..... A63B 69/36

[52] U.S. Cl. ..... 273/189 R; 272/143; 272/138; 272/139

[58] Field of Search ..... 273/183 B, 188 R, 188 A, 273/189 R, 189 A, 190 R, 190 A, 190 B, 191 R, 191 A, 191 B, 192; 272/143, 122, 123, 138

[56] References Cited

U.S. PATENT DOCUMENTS

| | | | |
|---|---|---|---|
| 650,656 | 5/1900 | Raabe | 273/189 R |
| 1,699,219 | 11/1925 | Bemish et al. | 273/189 R |
| 3,415,524 | 12/1968 | Vickers | 273/189 R |
| 3,419,277 | 12/1968 | Martin | 273/189 R |
| 3,442,513 | 3/1967 | Fisher | 273/188 R |
| 3,940,144 | 2/1976 | Dickie | 273/173 B |
| 4,134,589 | 1/1979 | Arena | 273/183 B |
| 4,229,002 | 10/1980 | Masters | 272/117 |
| 4,326,718 | 4/1982 | Kiehl | 273/183 B |
| 4,583,740 | 4/1986 | Ohly | 273/191 A |
| 4,662,640 | 5/1987 | Grander | 273/183 B |
| 4,817,954 | 4/1989 | Kubo | 273/191 R |
| 4,852,877 | 8/1989 | Scalf | 273/77 R |
| 4,890,841 | 1/1990 | Brooks | 273/188 R |
| 4,892,317 | 1/1990 | Corder, Jr. | 273/183 B |

*Primary Examiner*—George J. Marlo
*Attorney, Agent, or Firm*—Head & Johnson

[57] ABSTRACT

An exercise apparatus for a golfer for exercising muscles used during a golf swing. The apparatus includes a rigid upper chest member and a rigid lower chest member. A pair of rigid arm members are attachable to the golfer. Each arm member extends between the upper and the lower chest members. Elastic, resilient cords extend from the lower chest member to a foot stand so that resistance is provided to the movement of the golfer during a simulated golf swing.

8 Claims, 3 Drawing Sheets

GOLF SWING TRAINING DEVICE

BACKGROUND OF THE INVENTION

1. Field of the Invention

The present invention relates to an exercise apparatus to develop, stretch, and tone the muscles used by a golfer during a golf swing. In particular, the present invention relates to an exercise apparatus wherein a golf swing is simulated by a golfer while resistance is provided in order to develop, stretch, and tone the muscles used during a golf swing.

2. Prior Art

Increased study of exercising and advancement in the design of exercise apparatus have led to a recognition of the importance of simulating the movement of the specific activity for which the training is performed. While golf has a relatively low injury rate compared to other sports, it is known that muscle conditioning in the form of stretching and strength training will prevent injury, promote endurance and improve the distance of drives.

In golf, it has been found that specific groups of muscles are used during a golf swing. The primary muscle groups involved during a golf swing are; the quadriceps muscles, being the major anterior thigh muscles; the adductor muscles, which run along the underside of the forearm; the gluteus medius muscles, being the hip flexors that flex the trunk of the body toward the legs; and the abdominals or stomach muscles, including both the internal and external obliques.

While a series of exercises might be used to condition all of these muscle groups, the present invention allows all of these muscle groups to be exercised at the same time.

Previous attempts at golf swing devices have been directed to training a golfer to make a correct swing by restricting the movement of the golfer during the swing. An example of such training devices is seen in Grander (U.S. Pat. No. 4,662,640). A flexible, adjustable harness for the shoulders and chest having downwardly converging cords trains the golfer to make a correct repetitive swing.

Fisher (U.S. Pat. No. 3,442,513) discloses a device to position the golfer for the proper swing. A cord extends from a neck piece, through a belt, to an eye bolt on a base plate, and back to the belt.

Arena (U.S. Pat. No. 4,134,589) discloses a training device having a non stretchable cord which passes a pulley that is anchored in the ground. The ends of the cord have clips to attach to the golfer.

Dickie (U.S. Pat. No. 3,940,144) provides a device that may be used during golfing which aids the golfer in assuming a proper spread of the feet and flex of the knees.

While the present invention has an aspect of retaining the position of the golfer's arms with respect to his or her body, a primary aspect of the present invention is in strengthening or toning the muscles.

Accordingly, it is a principal object and purpose of the present invention to provide an exercise apparatus to develop the specific muscle groups used by a golfer during a golf swing.

It is a further object and purpose of the present invention to allow a golfer to simulate a golf swing while using the exercise apparatus to develop the specific muscle groups used by a golfer during a golf swing.

SUMMARY OF THE INVENTION

A golf exercise apparatus of the present invention for exercising muscles used during a golf swing is attachable to the upper arms of a golfer.

An upper chest member is substantially flat and rigid. The upper chest member may be composed of two overlapping pieces, adjustably held together by a series of pins received in openings. Accordingly, the length of the upper chest member is adjustable.

A lower chest member is substantially parallel to the upper chest member and is flat and rigid. The lower chest member may be comprised of two overlapping pieces adjustably held together by pins received in openings. Extending between the upper chest member and the lower chest member are a pair of rigid arm members constructed to accommodate the arms of the golfer. The arm members are arcuate in form in order to receive the arms.

A series of straps extend from each arm member. The straps of each arm member may be joined together to retain the arm of the golfer within the arcuate member. The straps may be secured to each other by a pressure sensitive hook and loop material, such as Velcro.

The lower chest member is secured to each of the arm members and extends therebetween. The upper chest member is pivotally secured to each arm member so that movement of the arm members with respect to the upper chest member is allowed during the simulated golf swing of the golfer.

The upper chest member and the lower chest member are adjusted in length so that the upper chest member is somewhat longer than the lower chest member. A trapezoid is, thus, formed by the upper and lower chest members and the arm members.

Resistance to the swing of the golfer is provided through a pair of elastic, resilient cords. One cord extends from the intersection of the lower chest member and the left arm member. The other cord extends from the intersection of the lower chest member and the right arm member.

Each cord extends therefrom to a foot stand. The foot stand contains a right foot receptacle and a left foot receptacle. The golfer places his or her feet in the foot receptacles which serves to retain the foot stand in place against the upward force supplied through the cords.

The spacing between the foot receptacles may be adjusted for the use of the individual golfer by a pair of overlapping pieces which are adjustably held together by a series of pins received in openings.

The amount of resistance provided against the work of the golfer during the simulated golf swing may be adjusted by adjusting the length of the cords. A lock mechanism extends from each foot receptacle so that the length of each cord may be adjusted.

DETAILED DESCRIPTION OF THE PREFERRED EMBODIMENTS

Figure 1:
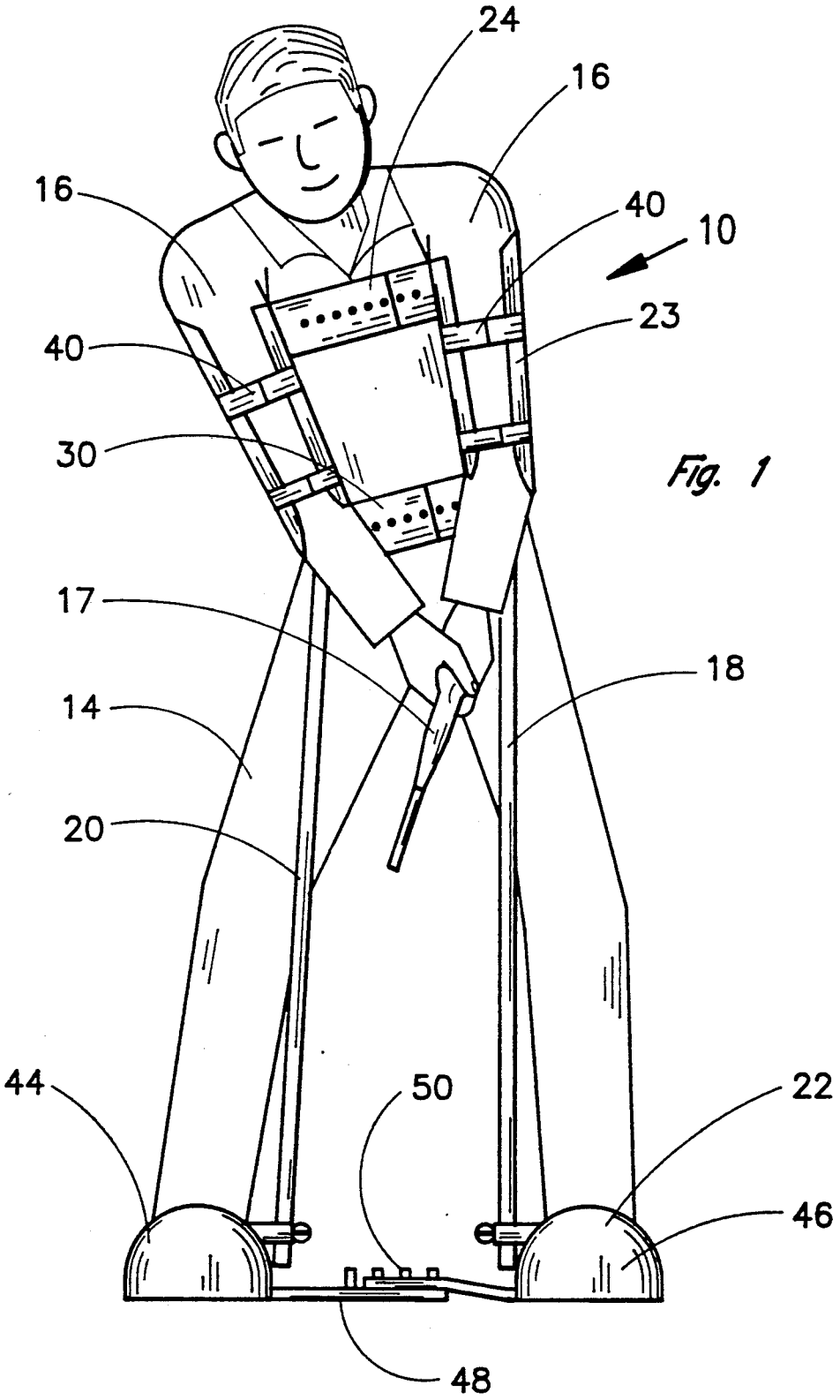
FIG. 1 is a perspective view of a golf exercise apparatus constructed in accordance with the present invention and shown in use by a golfer.

Referring to the drawings in detail, FIG. 1 shows a perspective view of a golf exercise apparatus 10 being used by a golfer 14. The apparatus may be used by a golfer with a right hand swing (as shown in FIG. 1) or with a left hand swing.

The apparatus 10 is attachable to the upper arms 16 of the golfer. With the apparatus in place, the golfer 14 is able to simulate the motion used during a golf swing.

It will be appreciated that the apparatus may be used outdoors or indoors, may be transported easily, and may be adjusted for use by golfers of all sizes.

The correct positioning of the arms with respect to the body is known to be important for a proper golf swing. During the simulated golf swing with the apparatus in place, a triangular position is retained by the golfer. The triangle is formed by the arms 16 which are held together at the hands and the distance across the chest at the shoulder blades. The hands may be held together around a training or practice grip 17 which is well known.

A pair of elastic, resilient cords 18 and 20 are attached at their lower ends to a foot stand 22. As will be described herein, the cords provide resistance against the work of the golfer during the simulated swing.

Figure 3:
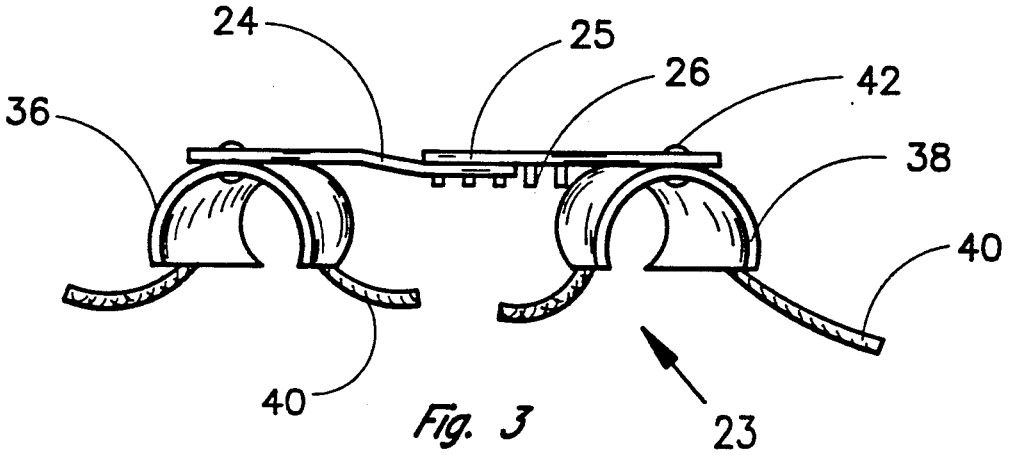
FIG. 3 is a top view of the upper portion of the golf exercise apparatus as seen in FIG. 2.
Figure 2:
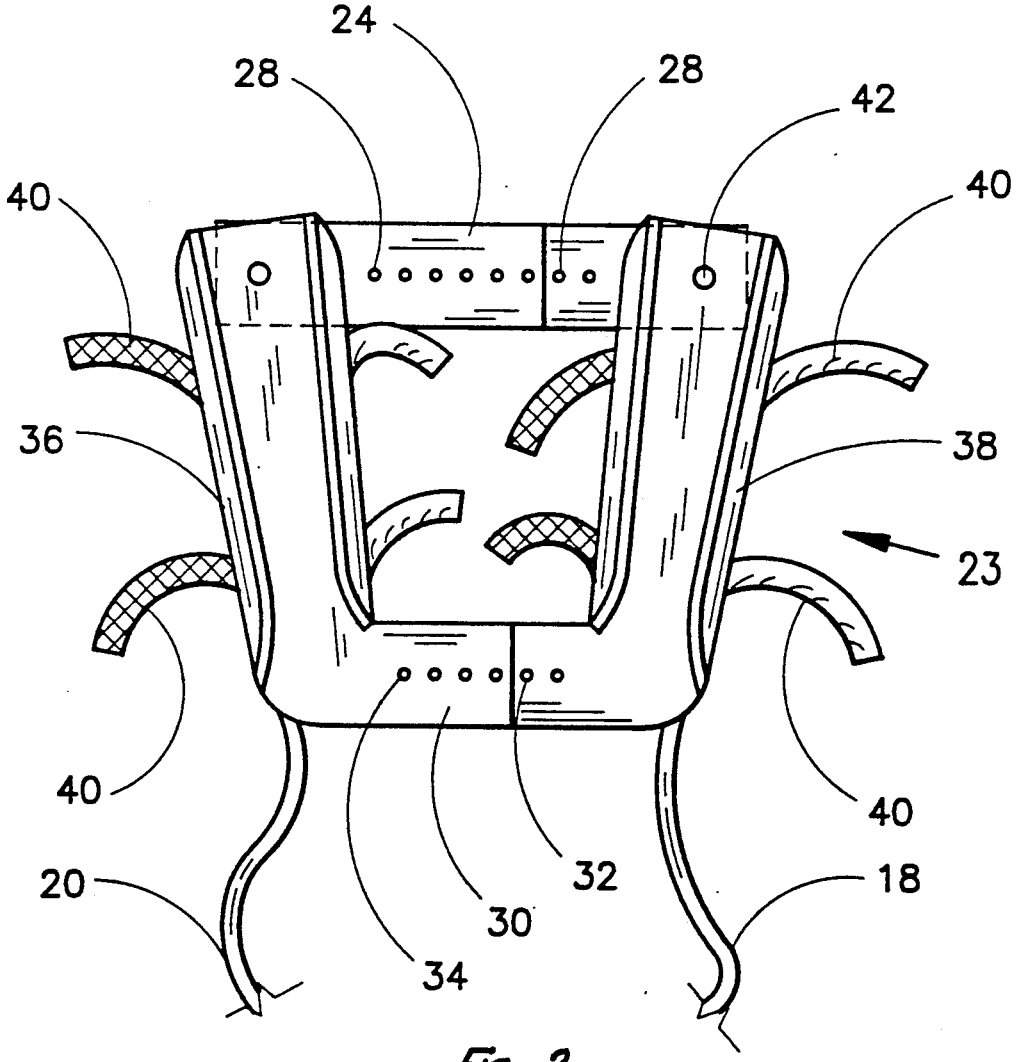
FIG. 2 is a front view of the upper portion of the golf exercise apparatus seen in FIG. 1 before being attached to the golfer.

FIG. 2 illustrates the upper portion 23 of the apparatus 10 before being attached to the golfer for use. FIG. 3 is a top view of the upper portion of the apparatus as shown in FIG. 2. An upper chest member 24 is substantially flat and rigid and may be fabricated from a hard plastic material. When in use the upper chest member 24 will rest against the chest of the golfer 14 but not be attached thereto. To accommodate golfers of different sizes, the upperchest member 24 may be composed of two overlapping pieces 25. The overlapping pieces 25 are adjustably held together by a series of longitudinally arrayed pins 26 extending from one piece which are received in openings 28 in the other piece. Accordingly, the length of the upper chest member is adjustable by separating the pieces 25, re-aligning them, and connecting the pins 26 in the openings 28. The pins fit snugly int he openings so that the overlapping pieces are retained in place. It will be recognized that other methods of adjustably lengthening the upper chest member might be utilized.

A lower chest member 30 is substantially parallel to the upper chest member 24 and is flat and rigid. The lower chest member 30 may be fabricated from a hard plastic. In similar fashion to the upper chest member, the lower chest member 30 may be comprised of two overlapping pieces. The overlapping pieces are adjustably held together by longitudinally arrayed pins 32 extending from one piece received in openings 34 in the other piece. Accordingly, the length of the lower chest member 30 is adjustable by separating the pieces, re-aligning them and connecting the pins 32 in the openings 34. The pins fit snugly in the openings so that the overlapping pieces are retained in place. It will be recognized that other methods of adjustably lengthening the lower chest member might be utilized.

Extending between the upper chest member and the lower chest member are a pair of arm members 36 and 38 constructed to accommodate the arms 16 of the golfer. The arm members will ideally be somewhat flexible and are arcuate in form as best seen in FIG. 3.

A series of straps 40 extend from each arm member 36 and 38. The straps 40 on each arm member may be joined together to retain the arm 16 of the golfer within the arcuate member. The straps may be secured to each other by a pressure sensitive hook and loop material, such as Velcro.

When the exercise apparatus 10 is secured to the golfer's arms, movement of the arm members 36 and 38 moves the chest members 24 and 30 as well.

The lower chest member 30 is secured to each of the arm members 36 and 38 and extends therebetween. The upper chest member 24 is pivotally secured to each arm member 36 and 38 and extends therebetween. Pivot pins 42 are seen in FIGS. 2 and 3. Movement of the arm members 36 and 38 with respect to the upper chest member is, thus, allowed by the pivoting connection.

The upper chest member 24 and lower chest member 30 are adjusted so that the upper chest member is somewhat longer than the lower chest member. In one position a trapezoid is, thus, formed by the upper and lower chest members and the arm members 36 and 38, as best seen in FIG. 2. This trapezoid shape determines the positioning of the golfer's arms with respect to each other.

With the arms 16 of the golfer 14 retained within the arm members 36 and 38, a triangle is formed. The arms of the golfer form two legs of the triangle and the distance across the chest at the shoulder blades forms the remaining leg.

Resistance to the swing of the golfer is provided through a pair of elastic and resilient cords 18 and 20. One cord 18 extends from the intersection of the lower chest member 30 and the left arm member 38. The other cord 20 extends from the intersection of the lower chest member 30 and the right arm member 36.

Figure 5:
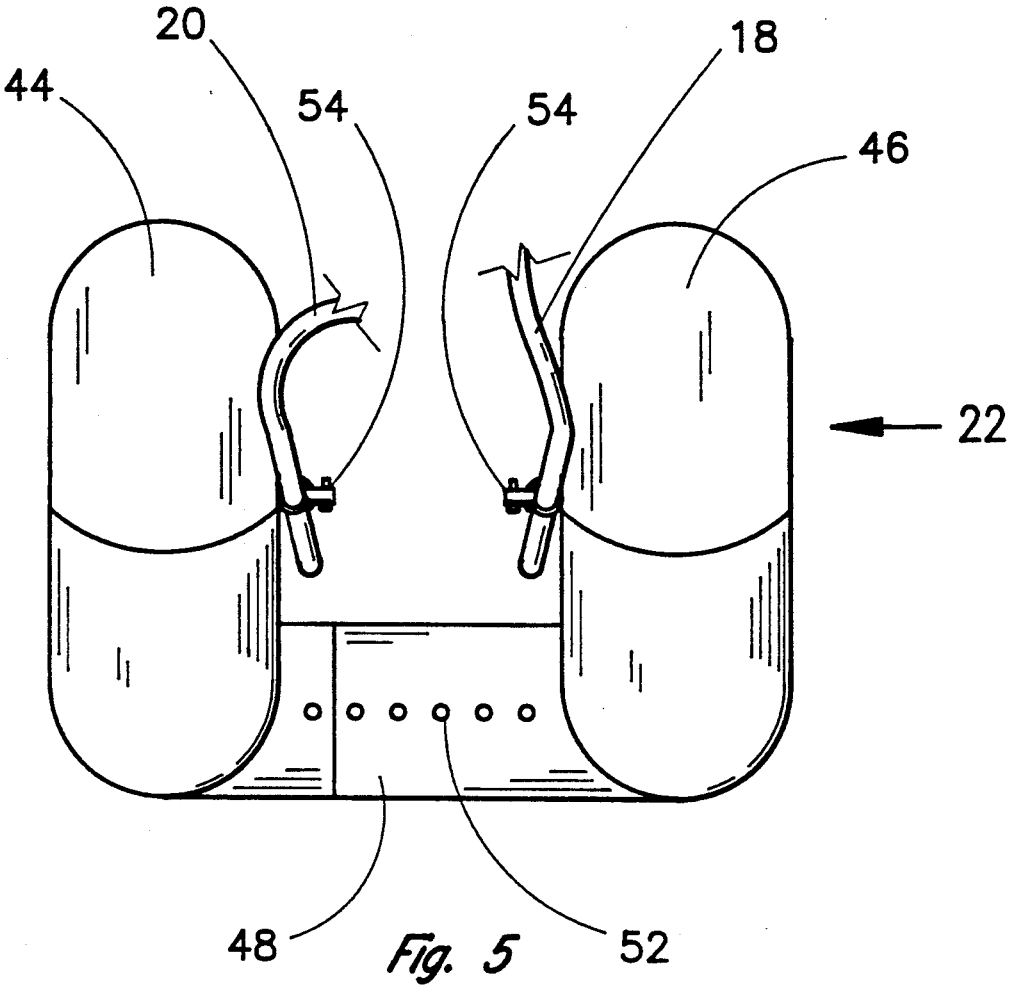
FIG. 5 is a top view of the foot stand shown in FIG. 4.
Figure 4:
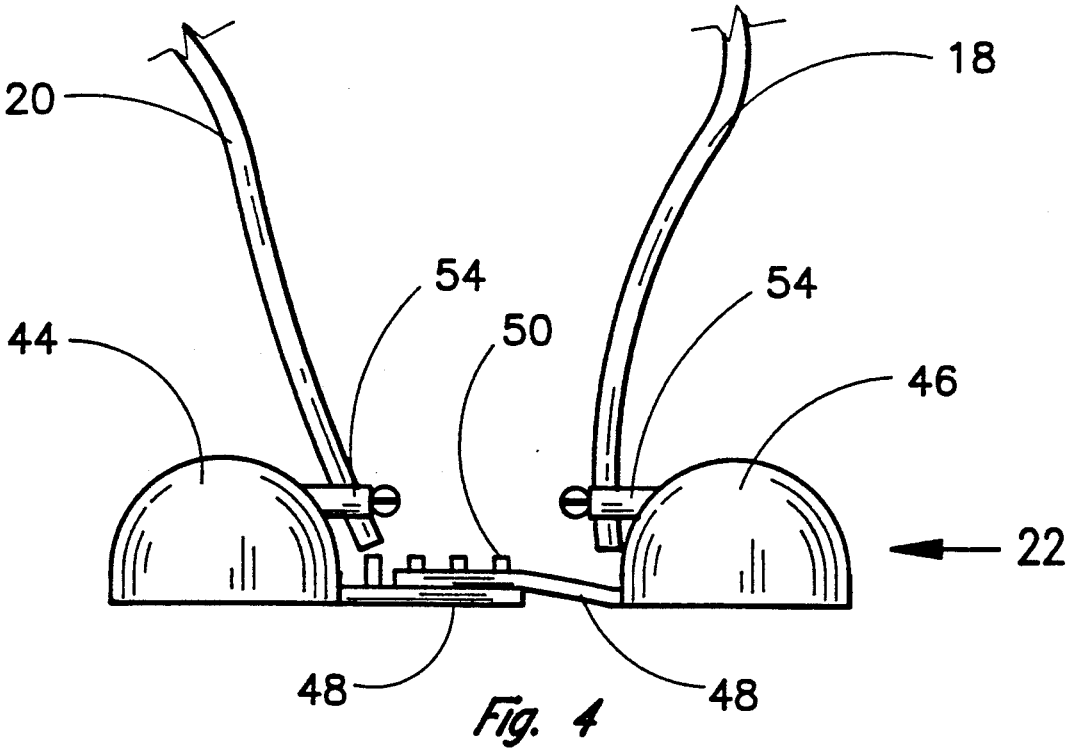
FIG. 4 is the foot stand of the exercise apparatus shown in FIG. 1.

The cords 18 and 20 extend therefrom to the foot stand 22, which is seen apart from the apparatus 10 in FIG. 4. FIG. 5 is a top view of the foot stand seen in FIG. 4. The foot stand contains a right foot receptacle 44 and a left foot receptacle 46. With reference to FIG. 1 and continuing reference to FIGS. 4 and 5, the golfer 14 will place his or her feet in the foot receptacles during use. The weight of the golfer, thus, rests on the foot stand. This serves to retain the foot stand in place against the force of the cords 18 and 20, upon which is delivered an upward force.

The spacing between the foot receptacles 44 and 46 may be adjusted for the use of the individual golfer by a pair of overlapping pieces 48. The overlapping pieces 48 are adjustably held together by a series of pins 50 extending from one piece and received in openings 52 in the other piece. Accordingly, the spacing between the foot receptacles may be varied by separating the pieces 48, re-aligning them, and connecting the pins 50 in the openings 52.

The amount of resistance against the work of the golfer may be adjusted by adjustment of the length of the cords 18 and 20. In the present embodiment, a lock mechanism 54 extends from each foot receptacle so that the length of the cord may be adjusted. The lock mechanism, alternatively, might be located elsewhere on the foot stand. In the present embodiment, the lock mechanism consists of a ring clamp extending from the foot receptacles 44 and 46. Adjustment of the length of the cords 18 and 20 will also be made to accommodate the various heights of the golfers.

In operation, the upper portion 23 of the apparatus 10 will be adjustably fitted to the upper body of the golfer 14 by adjusting the length of the upper chest member 24 and adjusting the length of the lower chest member 30. The arms 16 of the golfer 14 will then be snugly fit into the arcuate arm members 36 and 38. Thereafter, the straps 40 will be fastened around each arm of the golfer.

The golfer will then step into the foot receptacles and on the foot stand 22. The length of the cords 18 and 20 will be adjusted for the height and stance of the golfer. The overlapping pieces 48 of the foot stand 22 are adjusted so that the spacing between the foot receptacles is proper.

The knees of the golfer will be bent slightly as in a correct golf swing. A training or practice grip 17 may be held by the golfer to retain the correct positioning of the hands.

As the golfer moves his or her hands and arms back, the cords are stretched. He or she is pulling or working against the resistance of the body weight on the foot stand 22. The various muscle groups are, thus, developed and stretched by repetitious use.

Whereas, the present invention has been described in relation to the drawings attached hereto, it should be understood that other and further modifications, apart from those shown or suggested herein, may be made within the spirit and scope of this invention.

What is claimed is:

1. An exercise apparatus for a golfer for exercising muscles used in a golf swing which comprises:

a rigid upper chest member;

a rigid lower chest member;

a pair of rigid arm members attachable to said golfer, each said arm member extending between said upper and said lower chest members, means for connecting said arms members and chest members together so that said chest and arm members hold the golfer's arms in a correct position while exercising a proper golf swing;

a foot stand;

elastic, resilient resistance means extending from said lower chest member to said foot stand for providing resistance to the movement of said golfer during, said golf swing.

2. An exercise apparatus for a golfer as set forth in claim 1 wherein each said arm member is pivotally connected to said upper chest member.

3. An exercise apparatus for a golfer as set forth in claim 2 wherein in one position said upper chest member and said lower chest member are parallel to each other and form a trapezoid with said arm members.

4. An exercise apparatus for a golfer as set forth in claim 1 wherein one of said arm members is for the right arm of said golfer and the other of said arm members is for the left arm of said golfer, said resistance means including two elastic, resilient cords, one cord extending from the intersection of said lower chest member and said right arm member to said foot stand and the other said cord extending from the intersection of said lower chest member and said left arm member to said foot stand.

5. An exercise apparatus for a golfer as set forth in claim 3 including means for varying the amount of resistance from said cords.

6. An exercise apparatus for a golfer as set forth in claim 1 wherein said upper chest member and said lower chest member are each adjustable in length.

7. An exercise apparatus for a golfer as set forth in claim 1 wherein each of said arm members includes a plurality of straps to removably fasten said arm members to the arms of said golfer.

8. An exercise apparatus for a golfer as set forth in claim 1 wherein said foot stand has a right foot receptacle and a left foot receptacle for retaining the feet of said golfer in place and wherein the spacing between said receptacles is adjustable.

* * * * *